US006857478B1

(12) United States Patent
Weber

(10) Patent No.: US 6,857,478 B1
(45) Date of Patent: Feb. 22, 2005

(54) PACKAGED RESIDENTIAL FIRE SPRINKLER SYSTEM

(76) Inventor: Junata E. Weber, 4212 Gravois Ave., St. Louis, MO (US) 63116

( * ) Notice: Subject to any disclaimer, the term of this patent is extended or adjusted under 35 U.S.C. 154(b) by 80 days.

(21) Appl. No.: 10/279,615

(22) Filed: Jan. 29, 2003

(51) Int. Cl.[7] ..... A62C 25/00

(52) U.S. Cl. ..... 169/52; 169/13; 169/24; 239/68; 239/69; 239/148; 239/172

(58) Field of Search ..... 169/13, 24, 51, 169/52; 239/67–69, 146, 148, 172

(56) References Cited

U.S. PATENT DOCUMENTS 1,585,146 A * 5/1926 Himberger ..... 169/52
1,694,574 A * 12/1928 Witter et al. ..... 169/24
3,770,060 A * 11/1973 Forsyth et al. ..... 169/24
4,037,664 A * 7/1977 Gibson ..... 239/172
4,488,603 A * 12/1984 Schmittmann et al. ..... 169/24
4,729,434 A * 3/1988 Rohrbach ..... 169/24
5,553,673 A * 9/1996 Hackman ..... 169/24
6,719,065 B2 * 4/2004 Baughman ..... 169/52

* cited by examiner

*Primary Examiner*—Steven J. Ganey
(74) *Attorney, Agent, or Firm*—Frank A. Lukasik

(57) ABSTRACT

A fire sprinkler system assembled as a complete package 13D-13R-U.L. listed components including a fire pump/motor, electric controller, pipe fittings, manifold assembly, ball valve, flow switch, pressure switch, pressure gauge, and check valve, all mounted on a frame attached to a high density polyethelene base. The invention also uses optional water storage tanks.

5 Claims, 9 Drawing Sheets

80

81

| PSI \ GALLONS PER MINUTE | 25 | 30 | 35 | 40 | 45 | 50 | 55 | 60 | 65 | 70 | 75 | 80 |
|---|---|---|---|---|---|---|---|---|---|---|---|---|
| 25 | 1-1/2 hp | 1-1/2 hp | 1-1/2 hp | 1-1/2 hp | 1-1/2 hp | 3-hp | 3-hp | 3-hp | 3-hp | 3-hp | 5-hp | 5-hp |
| 30 | 1-1/2 hp | 1-1/2 hp | 1-1/2 hp | 1-1/2 hp | 1-1/2 hp | 3-hp | 3-hp | 3-hp | 3-hp | 3-hp | 5-hp | 5-hp |
| 35 | 1-1/2 hp | 1-1/2 hp | 1-1/2 hp | 1-1/2 hp | 1-1/2 hp | 3-hp | 3-hp | 3-hp | 3-hp | 3-hp | 5-hp | 5-hp |
| 40 | 1-1/2 hp | 1-1/2 hp | 1-1/2 hp | 1-1/2 hp | 2-hp | 3-hp | 3-hp | 3-hp | 3-hp | 3-hp | 5-hp | 7-1/2 hp |
| 45 | 2-hp | 2-hp | 2-hp | 2-hp | 3-hp | 3-hp | 3-hp | 3-hp | 5-hp | 5-hp | 5-hp | 7-1/2 hp |
| 50 | 3-hp | 3-hp | 3-hp | 3-hp | 3-hp | 3-hp | 3-hp | 5-hp | 5-hp | 5-hp | 7-1/2 hp | 7-1/2 hp |
| 55 | 5-hp | 3-hp | 5-hp | 5-hp | 5-hp | 5-hp | 5-hp | 5-hp | 7-1/2 hp | 7-1/2 hp | 7-1/2 hp | 7-1/2 hp |
| 60 | 5-hp | 5-hp | 5-hp | 5-hp | 5-hp | 5-hp | 5-hp | 7-1/2 hp | 7-1/2 hp | 7-1/2 hp | 7-1/2 hp | 7-1/2 hp |
| 65 | 5-hp | 5-hp | 5-hp | 5-hp | 5-hp | 7-1/2 hp | 7-1/2 hp | 7-1/2 hp | 7-1/2 hp | 7-1/2 hp | 7-1/2 hp | 7-1/2 hp |
| 70 | 5-hp | 5-hp | 5-hp | 7-1/2 hp | 7-1/2 hp | 7-1/2 hp | 7-1/2 hp | 7-1/2 hp | 7-1/2 hp | 7-1/2 hp | 7-1/2 hp | 7-1/2 hp |
| 75 | 7-1/2 hp | 7-1/2 hp | 7-1/2 hp | 7-1/2 hp | 7-1/2 hp | 7-1/2 hp | 7-1/2 hp | 7-1/2 hp | 7-1/2 hp | 7-1/2 hp | 7-1/2 hp | 7-1/2 hp |
| 80 | 7-1/2 hp | 7-1/2 hp | 7-1/2 hp | 7-1/2 hp | 7-1/2 hp | 7-1/2 hp | 7-1/2 hp | 7-1/2 hp | N/A | N/A | N/A | N/A |

82

Fig.8

PACKAGED RESIDENTIAL FIRE SPRINKLER SYSTEM

FIELD OF THE INVENTION

The present invention relates to residential fire sprinkler systems and, more particularly, to a fire sprinkler system assembled as a complete package from UL listed components including but not limited to; Fire pump/motor, electric controller, pipe, fittings, manifold assembly, Ball valve, flow switch, pressure switch, pressure gauge, dual click valve, all mounted on a high density polyethylene base. The invention being designed for residential use with optional water storage tanks.

BACKGROUND OF THE INVENTION

The use of water to suppress or extinguish fires is a concept as old as fire itself. And, quite probably as long as it has inhabited dwellings, mankind has long sought for the best way to effect the distribution of water within dwellings where the risk of death and destruction from fire is ever present. For many years, fire suppression systems which are installed in buildings have been comprised of a number of water supply lines installed above a ceiling or a suspended ceiling grid, the same grid which normally conceals other building utilities such as heating and cooling ducts, electrical supply lines and lighting fixtures among other things. The water supply lines, in turn are functionally adapted to supply water to sprinkler heads which are actuated by heat sensing means. This is, without question, old art. Various ancillary units support such installations with pumps, valves, sensors and other components to regulate the supply of water during a fire.

Prior art devices however, are limited to discrete components having U.L listed parts such as Pump/motor, U.L. controller being supplied separately and not as a package. Prior art devices do not lend themselves to self installation by homeowners or self/builders in conformity to local building codes because there has been no simple means for assembling discrete components which will perform according to codes. Because of the preponderance of home/building designs, each requiring a fire prevention system of its own, the cost of installing a sprinkler system increases according to the complexity thereof. There has been no inexpensive "plug and play" system which can be selected as a complete unit based upon the code requirements for a particular residence or building. Although the installation of piping and the fitting of sprinklers is a routine matter during construction, the assembly and installation of the components of the pumping system is far from routine and requires special training and experience to match the correct pump/motor combination for a given application. This does not afford any guarantee that these components in combination would perform to U.L standards.

Prior art systems utilize existing water supplies which are plumbed into the residence, these systems are often powered by the domestic power supply. This reliance on public utilities offers scant protection in the event of catastrophic failure of either (or both) the water or power supply.

SUMMARY OF THE INVENTION

It is therefore, a principal object of this invention to provide a new, useful and uncomplicated method and apparatus for selecting and installing the ancillary pumping and controlling means for water supplied to fire sprinkler grid in a residence or other building.

It is a further object of the invention to provide 13R and 13D U.L. listed modular units for deployment in various applications depending upon the size of the residence and local codes.

It is a further object of the invention to provide simple charts to facilitate the selection of units for a particular application.

It is a further object of the invention to provide tank storage means for water to supply the chosen system.

It is a further object of the invention to provide tanks sized according to the installation and to provide such tanks either as solid or flexible containers.

It is a further object of the invention to size some of the tanks so they will fit through doors to facilitate retro fitting of the sprinkler system It is a further object of the invention to provide alternative power sources for the pump units so they are not entirely dependent upon public utility power supplies.

It is a further object of the invention to provide completely packaged compact systems consisting of pump/motor, controller, manifold assembly all mounted on a polyethylene base, pre-wired and piped.

It is a further object of the invention to provide systems ranging in size from 1.5 HP to 10 HP single phase and 5 HP to 15 HP three (3) phase.

The present invention has obtained these objectives. It provides for a fire suppression apparatus suitable for, but not limited to, residential, condo, apartment, mobile home, schools, portable buildings, barns, warehouses, offices, trailers and other applications where water is scarce, where wells and domestic water may have insufficient flow or where organized fire protection is limited or non-existent, said invention comprising a self-contained controllable pumping means which is deployed simply by connecting it to a power and a water source.

The invention offers a choice of both power and water sources, the former including, but not limited to, connection to a solar array/battery supply where there is no municipal power or where such a supply is catastrophically interrupted or an inverter power supply using a battery bank back-up capable of converting from AC to DC in approximately 16 milliseconds. The latter system is designed to provide an instantaneous and secure supply of electricity to the controller and fire pump and can be used for telephone , emergency lighting and security systems. Using three stage auto charging as standard, (including solar if required) the inverter system is automatically protected against over discharging, overload or over charging with reset capabilities. The system is delivered with all wiring included and is provided in either a single inverter unit providing 115 Volts or a double unit providing 230 Volts, each using two U.L. listed sealed (10 year) maintenance/leak free 12 Volt batteries.

The invention provides for a range of motor sizes from 115/230-Single/three phase units from ¾ H.P. connecting to an appropriately sized (according to code specifications) centrifugal pump having a casing, impeller and shaft of stainless steel construction and AISI-304L liquid handling components for corrosion resistance and long life. The pump/motor combination being mounted on a corrosion resistant high density polypropylene base.

The invention controller component is contained within a strong, steel U.L. Listed NEMA-3R enclosure with a locking door (see U.L. Book Page 4). The control system contained therein is provided for automatic pump operation.

The control panel has power on pilot lights, voltage line meters, time delay, manual start push button,emergency mechanical run button with hold down mechanism, pressure switch. The controller is supplied ready to be connected to a power source. The invention pump/manifold assembly is constructed using all brass fittings and includes a 1" dual check valve with a U.L. water pressure gauge, U.L. Listed pressure and water flow switches, a 1" U.L. brass full port ball valve with a locking handle for security. The invention pump manifold assembly is supplied ready to be connected to Electric sprinklers and is used with one of the water supply storage tanks.

The invention water tanks range in size from a 300 gallon, 33"×92" which will fit through a standard 36" door up to 30,000 gallon tanks for above or below ground.

The foregoing and other features of the method and apparatus of the present invention will be further apparent from the detailed description which follows.

BRIEF DESCRIPTION OF THE DRAWINGS

FIG. 8 is a specification matrix for selecting components of the invention accordeng to requisite code specifications.

DETAILED DESCRIPTION OF THE INVENTION

Figure 1:
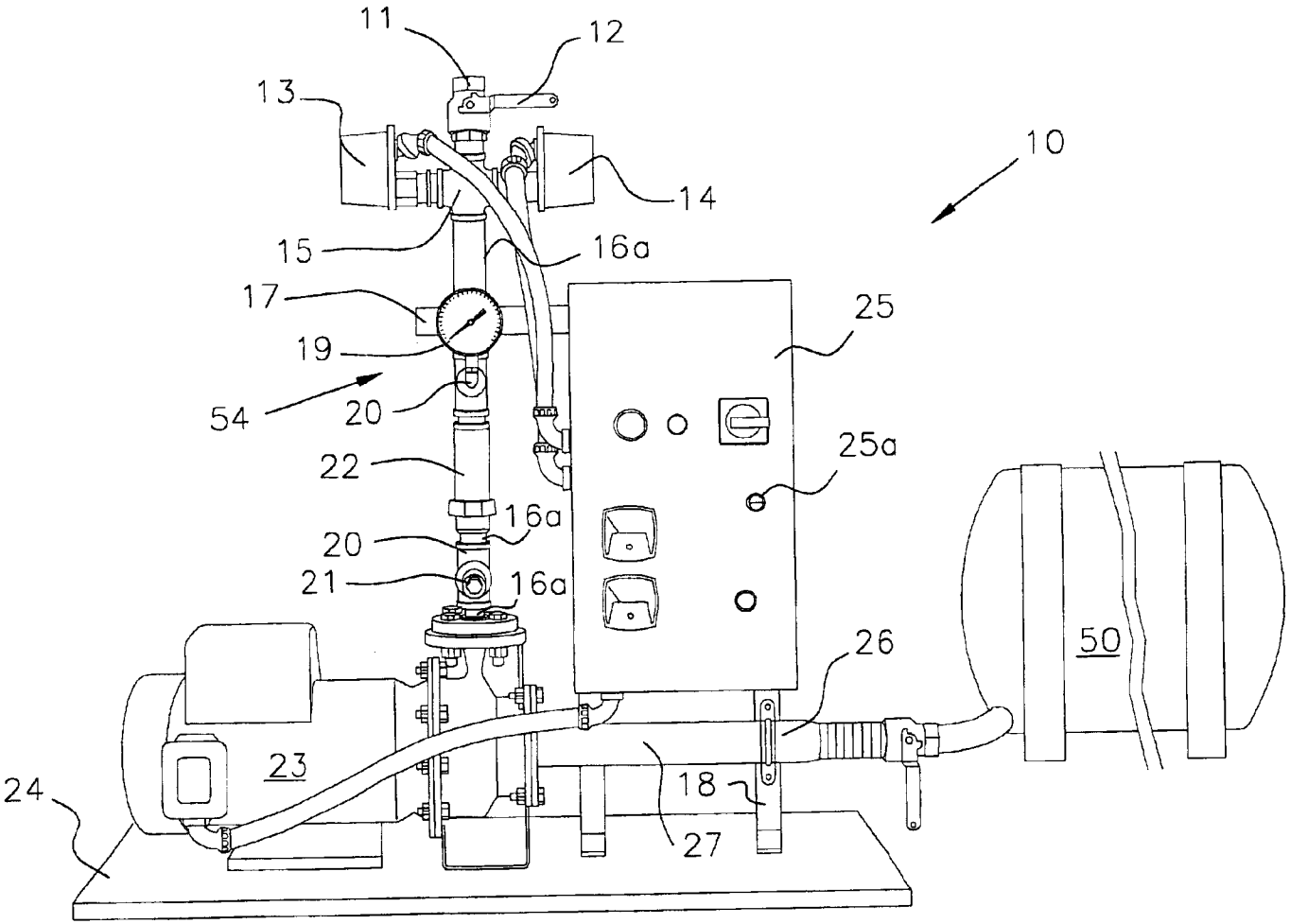
FIG. 1 is a schematic view of the invention as described.
Figure 7:
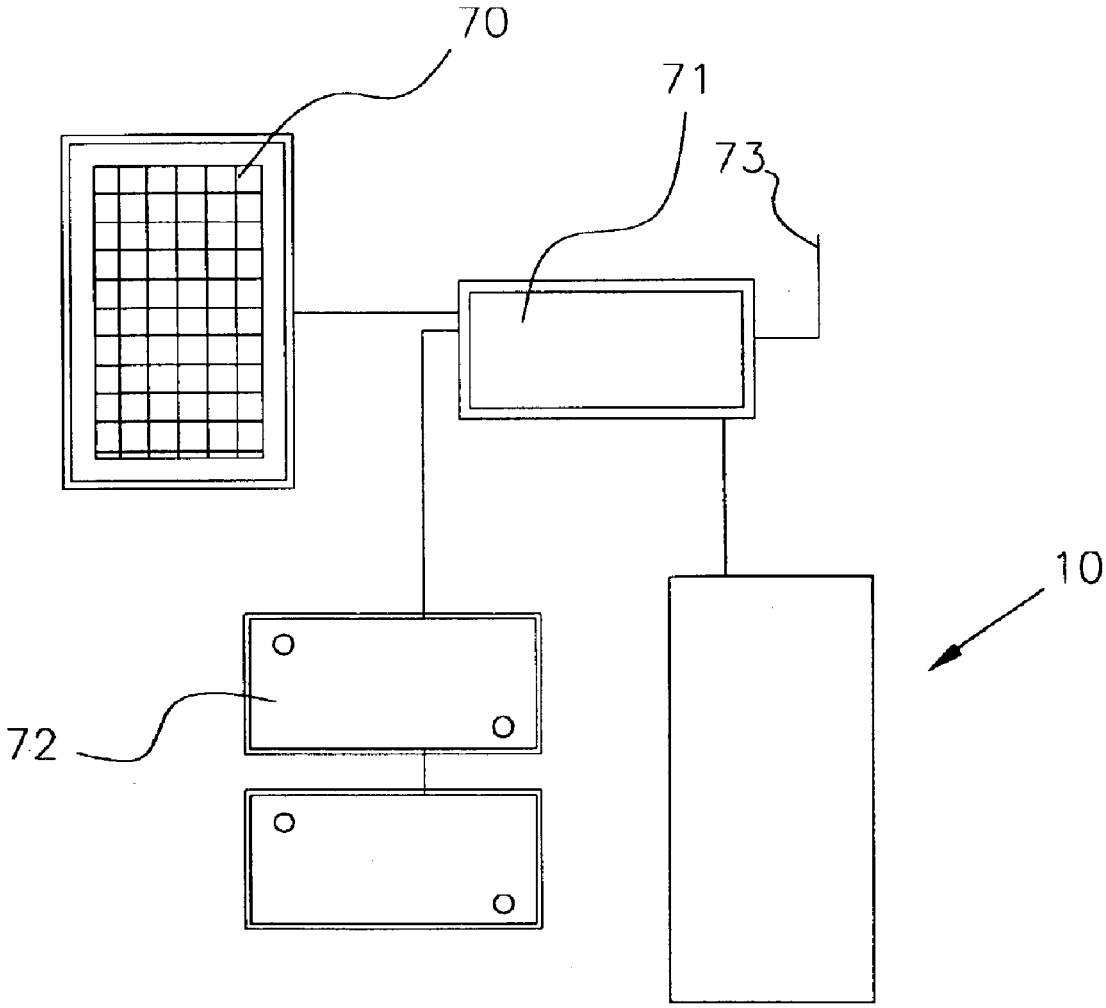
FIG. 7 is a schematic view of alternative power sources for the invention.

Referring now to the drawings in which like and corresponding numbers designate like and corresponding parts throughout the several views, in FIGS. 1 and 7 the invention is designated overall by the numeral 10. The water outlet manifold 54 consists of a vertical assembly including a ball valve 11 with a locking handle 12 connected to a cross 15. Ball valve 11*b* is a brass fill port valve with a locking handle 12. Water flow switch 13 and pressure switch 14 are connected on opposite sides of the cross 15. Nipple 16 connected downwardly from cross 15 is fastened to frame 18 with clamp 17. Also connected to nipple 16 is "T" connection 20. A pressure gauge 19 is mounted on the "T" connection 20. A circulation relief valve 21 is connected to the "T" connection 20. A Teflon seated dual check valve 22 with a teflon disc is connected between pressure gauge 19 and pump motor circulation relief valve 21. The pump motor assembly 23 includes a properly sized pump. Centrifugal stainless steel construction of the casing, impeller and shaft A151-304L, liquid handling components provides corrosion resistance and long life. Inlet pipe 26 is connected to the input end of pump assembly 23 and attached to frame 18 with clamp 17. Frame 18 is attached to base 24. Base 24 consists of rust-free, high density polyethelene base.

Figure 2:
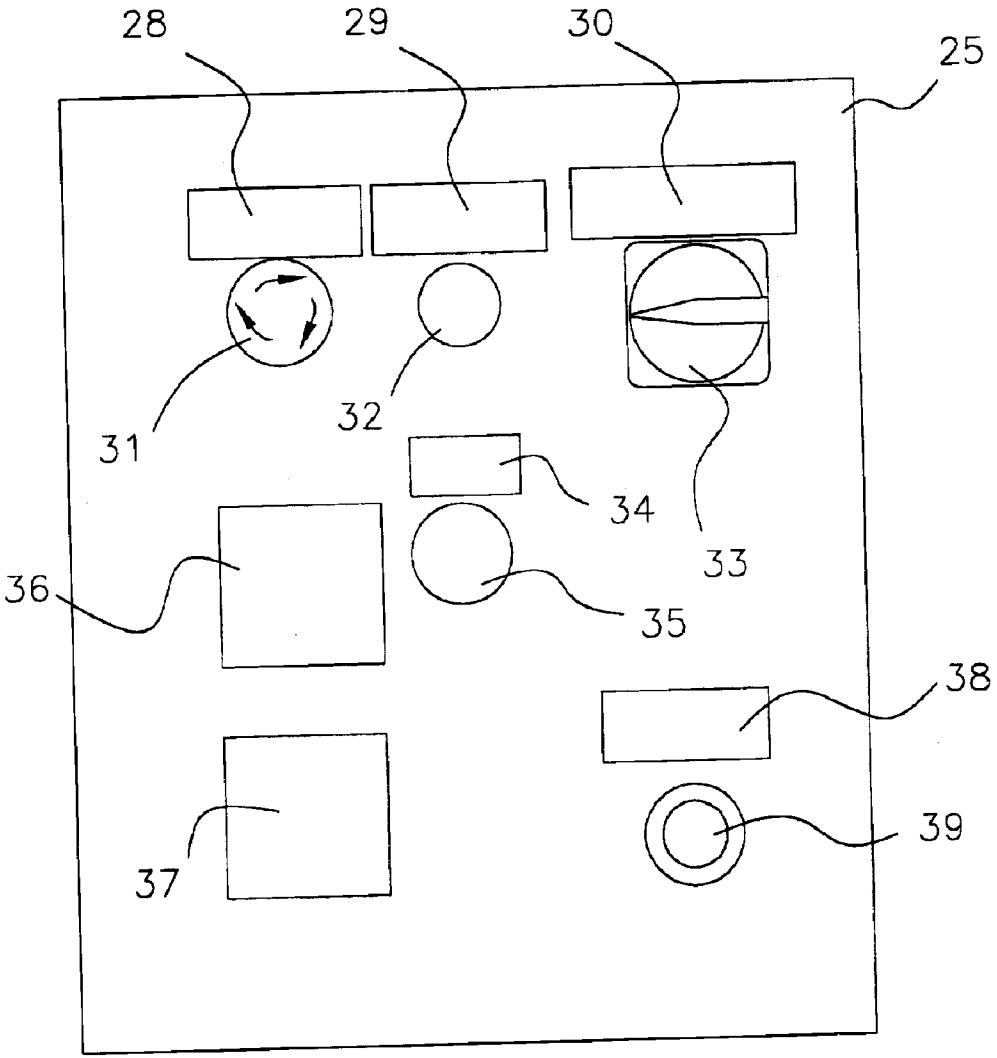
FIG. 2 is a schematic view of the front panel layout of the invention.
Figures 3, 4:
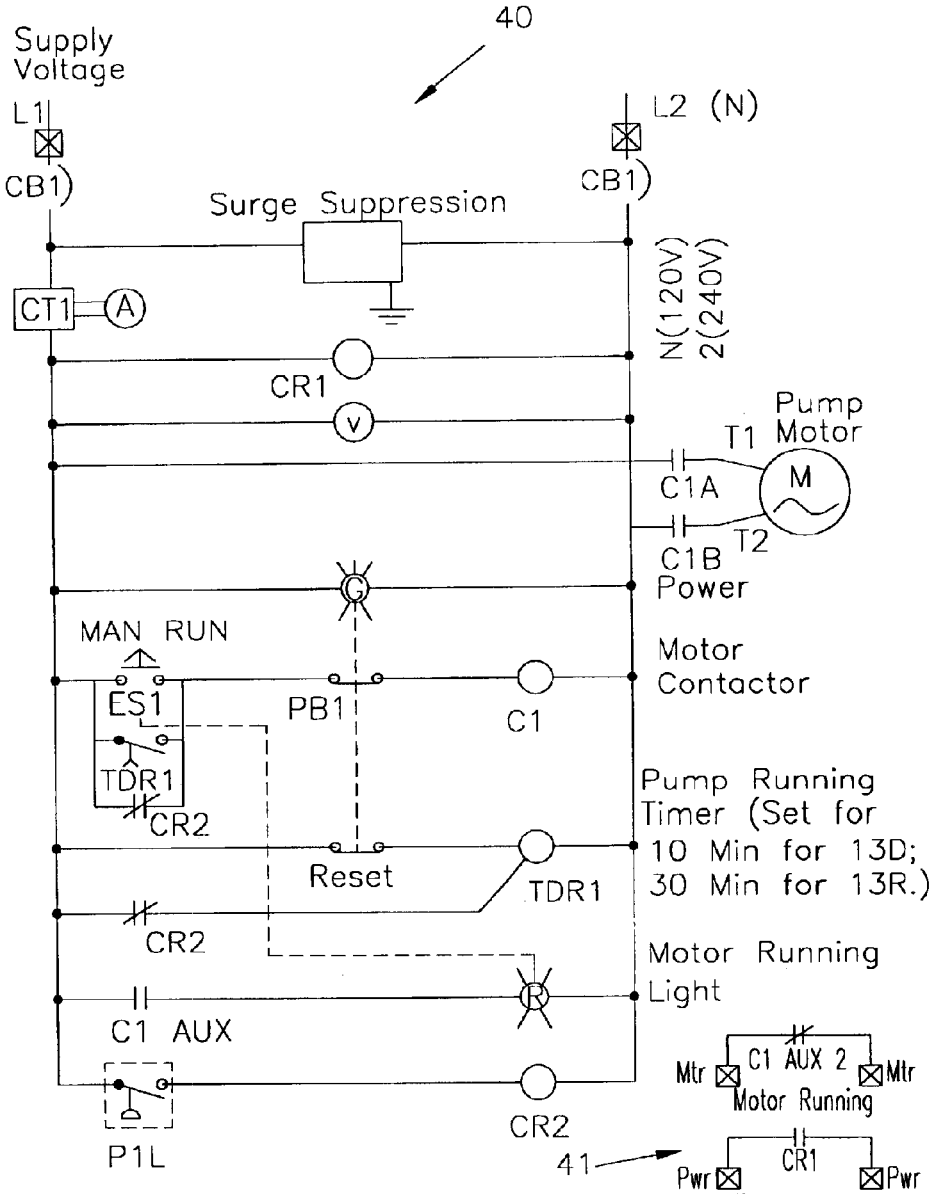
FIG. 3 is an electrical schematic of a first embodiment of the invention.
FIG. 4 is a schematic of contacts for external systems of the invention.
Figure 5:
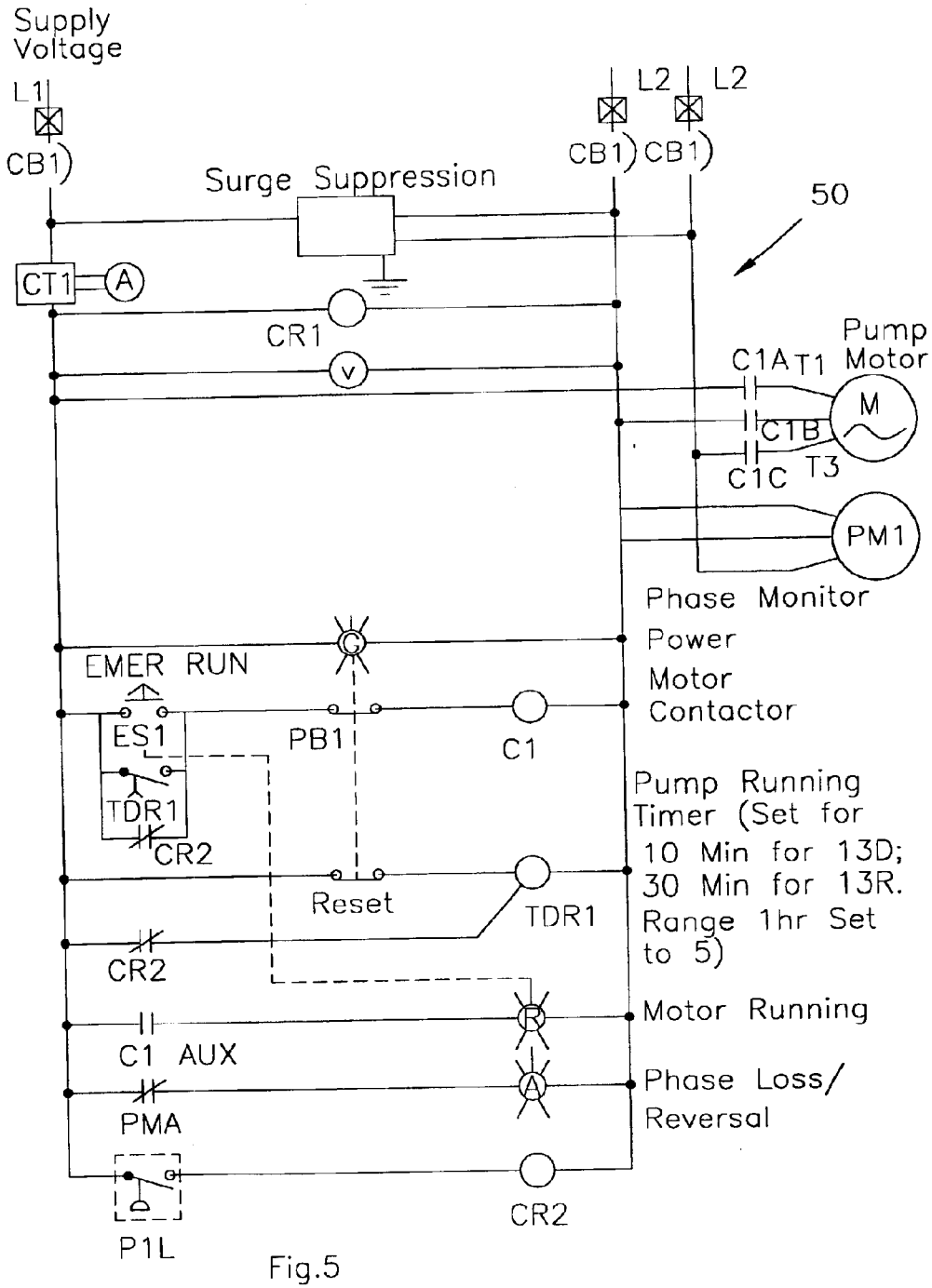
FIG. 5 is an electrical schematic of a further embodiment of the invention.
Figure 6:
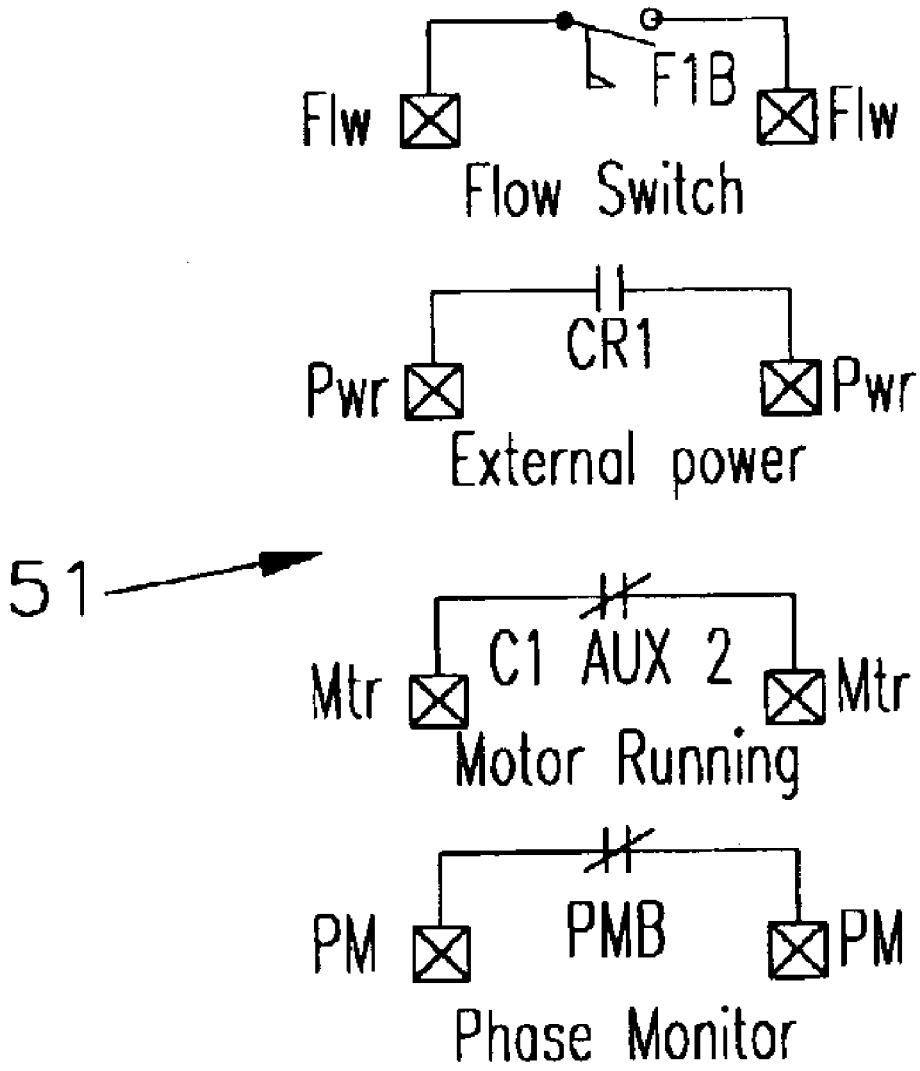
FIG. 6 is a schematic of contacts for external systems of the further embodiment of the invention.

Controller 25 enclosure is a strong, steel, U.L. Listed, NEMA-3R, with a locking door for security. Controls are designed to provide complete automatic pump operation. All components are pre-wired including a terminal strip. The control panel is clearly marked with a digital meter display for volts and amps. Referring to FIG. 2, controller 25 is fitted with: manual run light 31 (label 28), power stop/reset 32 (label 29), circuit breaker disconnecting means 33 (label 30), phase error light 35 (label 34), Volt gauge 36, Amp gauge 37, and manual/emergency run switch 39 (label 38). Minimal floor space is required and the pre-package pump/controller of the invention may be assembled where needed. Water gravity feed from tank to pump. Another option is an automatic water fill valve and float assembly and other options.

In FIG. 7, controller 25 is ready to hook up to solar panel array 70, inverter 71, and battery bank 72 to provide alternate power sources to the fire sprinkler system 10 in the event that utility power supply 73 is interrupted.- Inverter 71 draws power from power supply 73 to charge battery bank 72, solar array 70 (in the alternative) charges the battery bank 72. The inverter 71 is designed to provide an instantaneous and secure supply of electricity to controller 25 and fire pump system 23. The power may also be used for telephone, emergency lighting and security systems. The inverter 71 transfers power from DC to AC in about 16 milliseconds. Three stage auto charging is standard. Solar panels 71 for charging are optional when needed. Automatic protection against over discharging, overload or over charging are also provided. The solar panels 71 are designed for each particular part of the country.

Figure 10:
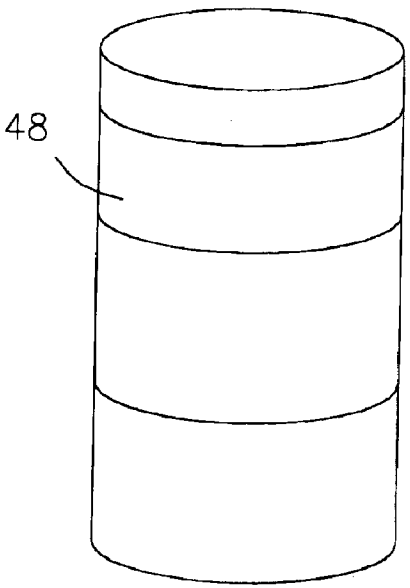
FIG. 10 is a perspective view of an assembled sectional water tank design.
Figure 9:
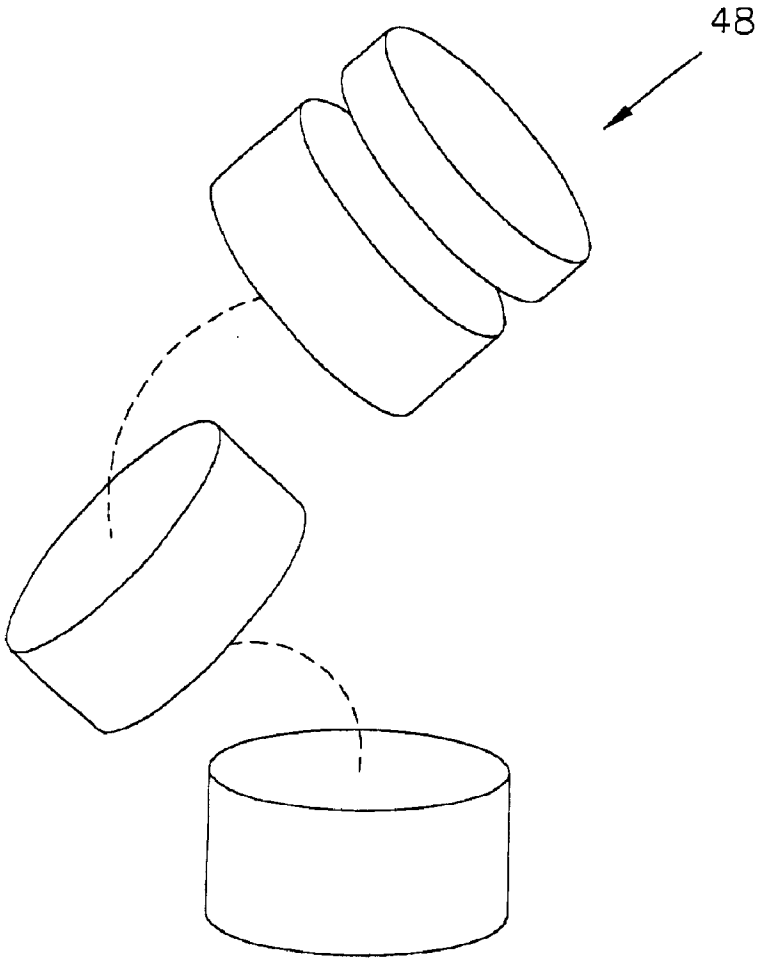
FIG. 9 is a perspective view of a sectional design.
Figure 11:
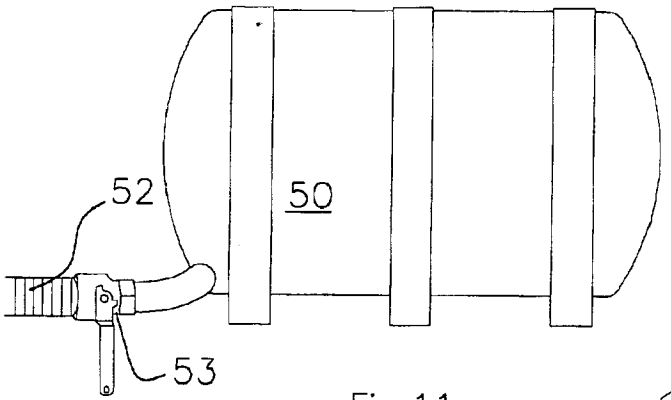
FIG. 11 is a perspective view of a 300 gallon tank.
Figure 13:
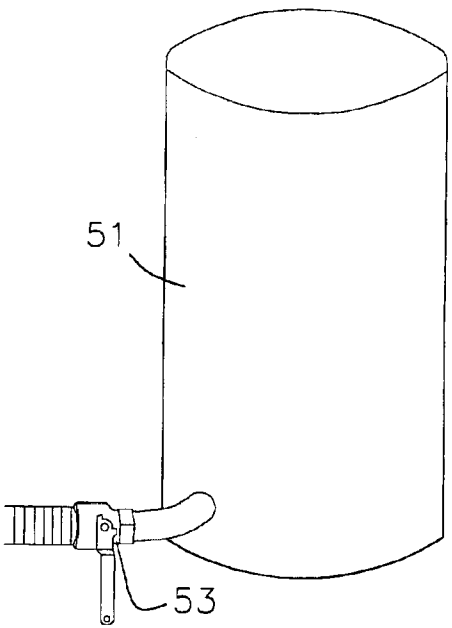
FIG. 13 is a perspective view of a 3,000 gallon tank.

FIGS. 9–13 show the various sizes and shapes of the aquatank system of the invention. FIG. 9 discloses a unique sectional design of tank 48 which complies with ANSI/NSF Certified Standard 61 for water. The lightweight, high strength, easy to install tank 48 is ideal for small, tight space, small door, halls, stairs, etc. FIG. 10 shows the tank 48 assembled. Horizontal tank 49 and vertical tank 48 are also shown.

Figure 12:
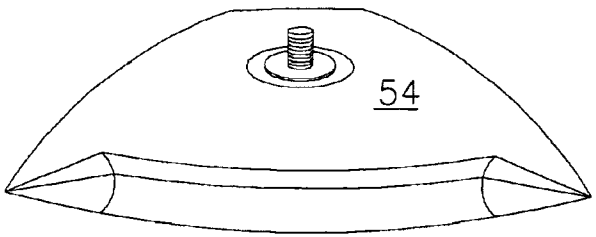
FIG. 12 is a perspective view of a collapsible aqua storage tank.

FIG. 12 shows a collapsible storage tank 50. The collapsible tank 50 is a convenient and economical alternative to rigid, bulky tanks, as they -are easily and readily transportable as they are made from Heavy-duty, nylon reinforced Elastomer material per U.S. Government Standards and FDA and ASTM Standards. The collapsible tank 50 is complete with a fill plate, valve and fittings.

FIG. 8 shows a chart 80 comprised of pressure scale 82 on a "Y" axis and flow rate scale 81 on an "X" axis. The chart presents pre-calculated motor/pump values for the invention in its various embodiments as different power, pressure and volume parameters are required for specific applications. In use, the scale carries the following instructions:

"To determine the pump horsepower, first determine the flow required and the pressure needed at the highest elevation. The flow is the result of which sprinkler head is (to be) used and whether one, two or more heads will be used for the final calculation.

The design pressure will be the pressure in P.S.I. that will be required by the sprinkler head at the furthermost point. Add in for elevation and friction loss in the pipe for the final total pressure requirement. The local authority will outline the parameters that must be followed.

Once the operating conditions are determined, enter the chart by matching the flow across the top and then move down the row until lined up with the desired pressure located on the left side of the chart. The horsepower of the system has been determined.

The above detailed description of the present invention is given for explanatory purposes. It will be apparent to those skilled in the art that numerous changes and modifications may be made without departing from the scope of the invention. Accordingly, the whole of the foregoing description is to be considered in an illustrative and not a limitative sense, the scope of the invention being defined solely by the appended claims.

What is claimed is:

1. A self contained modular fire sprinkler system for residential and light industrial use, said system comprising:

a high density polythelene board base, said base being generally rectangular, a vertical frame attached to said base, a water outlet manifold attached to said frame, said manifold consisting of a vertical assembly including a brass fill port ball valve having a locking handle, said ball valve being connected to a cross, said cross having a first side and a second side, a water flow switch connected to said first side, a pressure switch connected to said second side, a first end of a first nipple being connected downwardly to said cross, a second end of said first nipple being connected at a first end to a "T" connection, a pressure gauge being mounted on said "T" connection, a first end of a dual check valve being connected to said "T" connection at a second end, a first end of a second nipple being connected to a second end of said check valve, a pump motor circulation relief valve being connected to said dual check valve, and a pump motor output being connected said check valve, said pump motor having an inlet pipe, said inlet pipe being fastened to said frame, said pump motor being fastened to said base, a water supply connected to said inlet pipe, and a controller fastened to said frame, said controller being connected to a power source, said pump motor, and said manifold switches.

2. A self contained modular fire sprinkler system of claim 1 wherein said water supply consists of a self contained, water storage tank.

3. A self contained modular fire sprinkler system of claim 2 wherein said water storage tank consists of a collapsible, heavy-duty, nylon reinforced Elastomer material.

4. A self contained modular fire sprinkler system of claim 1 wherein said controller power source consists of a battery pack, an inverter and solar panels.

5. A self contained modular fire sprinkler system of claim 4 wherein said power source is connected to a telephone, emergency lighting and security system.

* * * * *